US010413102B2

(12) United States Patent
Dowd et al.

(10) Patent No.: US 10,413,102 B2
(45) Date of Patent: Sep. 17, 2019

(54) STABLE BEVERAGE CONTAINER

(71) Applicant: Telebrands Corp., Fairfield, NJ (US)

(72) Inventors: Paul Dowd, Scarsdale, NY (US); Norman L Barrigas, Danbury, CT (US)

(73) Assignee: Telebrands Corp., Fairfield, NJ (US)

( * ) Notice: Subject to any disclaimer, the term of this patent is extended or adjusted under 35 U.S.C. 154(b) by 246 days.

(21) Appl. No.: 15/415,316

(22) Filed: Jan. 25, 2017

(65) Prior Publication Data

US 2018/0208389 A1 Jul. 26, 2018

(51) Int. Cl.
*A47G 19/22* (2006.01)

(52) U.S. Cl.
CPC ..... *A47G 19/2272* (2013.01); *A47G 19/2261* (2013.01)

(58) Field of Classification Search
CPC ..... A47G 19/2272; A47G 19/2261
USPC ..... 220/483
See application file for complete search history.

(56) References Cited

U.S. PATENT DOCUMENTS

| | | | | |
|---|---|---|---|---|
| 8,025,169 | B2 | 9/2011 | Zimmerman | |
| 8,028,850 | B2 | 10/2011 | Zimmerman | |
| 8,757,418 | B2 | 6/2014 | Zimmerman | |
| 2015/0327727 | A1* | 11/2015 | Wu | B05D 3/0254 215/12.2 |

* cited by examiner

*Primary Examiner* — Andrew T Kirsch
*Assistant Examiner* — Don M Anderson
(74) *Attorney, Agent, or Firm* — Cooper & Dunham, LLP

(57) ABSTRACT

A beverage container including an outer cup having an integrally formed base plate, an inner cup disposed in the outer cup, a base including a lower portion configured to releasably engage the beverage container to an external surface, the lower portion including a suction cup defining a cavity and configured to sealingly engage the beverage container with an external surface by forming a seal between the suction cup and the external surface, and a valve operably connected to the integrally formed base plate and movable between a first position and a second position to control fluid communication between atmospheric pressure and the cavity.

17 Claims, 11 Drawing Sheets

STABLE BEVERAGE CONTAINER

TECHNICAL FIELD

The present invention relates generally to beverage containers. More specifically, the present invention to stable beverage containers having tip-resistant components that enhance their stability.

BACKGROUND OF THE INVENTION

Generally, beverage containers, such as glasses, mugs, bottles, and cans are susceptible to tipping due to their size and shape and the environment in which they are used (i.e., in an automobile). For example, certain glasses and mugs are designed to be wider at their open ends than at their closed ends. These configurations typically result in instability when external forces act upon the beverage containers.

Because of the instability problems that exist with certain glasses, mugs, bottles, and cans, beverage containers have been designed to substantially prevent liquids from spilling when the beverage containers tip over. For example, certain beverage containers include spill proof covers. However, problems remain with these beverage containers, because the lids only prevent spilling when in the closed position. When the lids of the beverage containers are in the open position, they are still susceptible to tipping and, as a result, spilling the liquid in the containers.

There is, therefore, a need for beverage containers that contain tip-resistant components so that the beverage containers have enhanced stability and substantially prevent spilling of the liquid therein when a lateral force acts on the beverage containers.

SUMMARY OF THE INVENTION

An embodiment of the present invention can provide a beverage container including an outer cup having an integrally formed base plate, an inner cup disposed in the outer cup, and a base including a lower portion configured to releasably engage the beverage container to an external surface. The lower portion can include a suction cup defining a cavity and configured to sealingly engage the beverage container with an external surface by forming a seal between the suction cup and the external surface, and a valve operably connected to the integrally formed base plate and movable between a first position and a second position to control fluid communication between atmospheric pressure and the cavity.

The lower portion of the base can include at least one port extending therethrough, where the at least one port can allow fluid communication between the cavity and atmospheric pressure. Further, the first position can include the valve sealingly engaged with the lower portion of the base so as to prevent fluid communication between the cavity and atmospheric pressure to sealingly engage the beverage container to the external surface. According to certain aspects, the lower portion can include an O-ring such that the valve is sealingly engaged with the O-ring in the first position.

According to certain embodiments, the second position can include the valve being disposed in a position so as to allow fluid communication between the cavity and atmospheric pressure such that the beverage container is not sealingly engaged to the external surface. Further, the vertical displacement of a first predetermined distance of the valve can move the valve between the first and second positions. Additionally, the valve can include projections configured to operatively engage the integrally formed base plate, and a configuration of the projections and the integrally formed base plate can define the first predetermined distance.

According to certain aspects, the valve can be operably coupled with the integrally formed base plate such that when the outer cup is displaced a second predetermined distance, the valve can remain sealingly engaged with the suction cup thereby maintaining the airtight seal between the suction cup and the external surface.

According to certain embodiments, the base can include an upper portion, which can further include clips configured to operatively engage a circumferential lip of the integrally formed base plate. Further, the configuration of the clips and the circumferential lip can define a second predetermined distance, such that when the outer cup is laterally displaced up to the second predetermined distance, the valve can remain sealingly engaged with the lower portion of the base.

According to certain embodiments, the base can include tabs to centrally align the valve with the O-ring. According to certain aspects, the outer cup can include stainless steel. According to certain aspects, the inner cup can include a ceramic lining.

Another embodiment can provide a beverage container including an outer cup having an integrally formed base plate, an inner cup disposed in the outer cup, a base which includes a lower portion configured to releasably engage the beverage container to an external surface and an upper portion which includes clips configured to operatively engage a circumferential lip of the integrally formed base plate, and a valve which includes projections configured to operatively engage the integrally formed base plate and movable between a first position and a second position to control fluid communication between atmospheric pressure and the cavity. The first position can include the valve being sealingly engaged with the lower portion of the base so as to prevent fluid communication between the cavity and atmospheric pressure in order to sealingly engage the beverage container to the external surface, and the second position can include the valve being disposed in a position that allows fluid communication between the cavity and atmospheric pressure such that the beverage container is not sealingly engaged to the external surface. The lower portion of the base can including a suction cup defining a cavity and configured to sealingly engage the beverage container with an external surface by forming a seal between the suction cup and the external surface, an O-ring, and at least one port extending therethrough, the at least one port allowing fluid communication between the cavity and atmospheric pressure.

According to certain embodiments, the valve can be sealingly engaged with the O-ring in the first position. According to certain aspects, the base can include tabs to centrally align the valve with the O-ring.

According to certain embodiments, a configuration of the projections and the integrally formed base plate can define a first predetermined distance, such that a vertically displacement of the first predetermined distance of the valve moves the valve between the first and second positions.

According to certain embodiments, a configuration of the clips and the circumferential lip can define a second predetermined distance, such that when the outer cup is laterally displaced up to the second predetermined distance, the valve remains sealingly engaged with the lower portion of the base.

BRIEF DESCRIPTION OF THE DRAWINGS

The above-mentioned and other aspects, features and advantages can be more readily understood from the following detailed description with reference to the accompanying drawings, wherein.

DETAILED DESCRIPTION

The present invention relates to beverage containers. More specifically, the prevent invention concerns stable beverage containers having tip-resistant components. It should be noted that the present invention should not be limited to containers for beverages. The present invention may be any container that may require stability. Additionally, while the containers described herein may be referred to as beverage containers, embodiments of the present invention may hold any item(s) that may fit therein.

Figure 1:
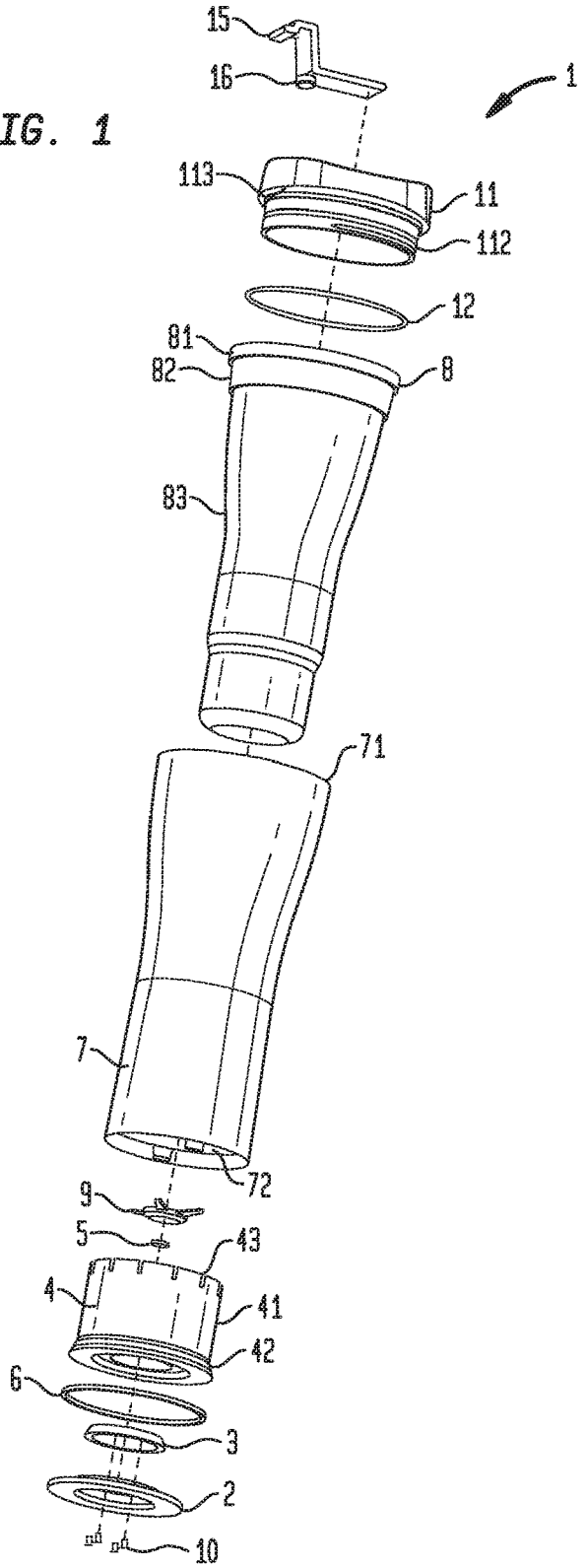
FIG. 1 is an exploded view of a stable beverage container, according to an exemplary embodiment.

FIG. 1 illustrates an exploded view of a beverage container 1, according to an embodiment of the present invention. As illustrated in FIG. 1, the beverage container 1 may include an inner cup 8 and an outer cup 7. The inner and outer cups 8, 7 may be any size, shape, and/or configuration such that the inner cup 8 may be configured to fit within the outer cup 7. The inner cup 8 may include at least one engagement component 81, 82 such that the inner cup 8 may be configured to engage the outer cup 7 when the inner cup 8 is fully positioned within the outer cup 7. The at least one engagement component 81, 82 may be any engagement mechanism known to those skilled in the art, including, but not limited to, threading, brackets, and/or tabs. In some embodiments, such as the embodiment illustrated in FIG. 1, the at least one engagement component 81, 82 may include an outer rim 81 and outer cuff 82 that may be positioned on a top portion of the inner cup 8. The outer rim 81 and the outer cuff 82 may be configured to engage the corresponding rim 71 and inner surface of the outer cup 7, respectively via friction and/or snap fitting.

The inner cup 8 may be sized relative to the outer cup 7 such that when the inner cup 8 is fully engaged with the outer cup 7, a bottom portion 83 of the inner cup 8 remains substantially spaced from an inner surface of the outer cup 8. That is, the bottom portion 83 of the inner cup 8 may be sized, shaped, and/or configured such that there may be a space between the outer surface of the bottom portion of the inner cup 83 and the inner surface of the outer cup 7 when the inner cup 8 and outer cup 7 are engaged. This spatial relationship between the outer cup 7 and inner cup 8 may be desirable for beverage containers to aid in insulation of beverages in the beverage container. Accordingly, the inner cup 8 may further be sized, shaped and/or configured to hold a liquid therein having any desired temperature.

Figure 2B:
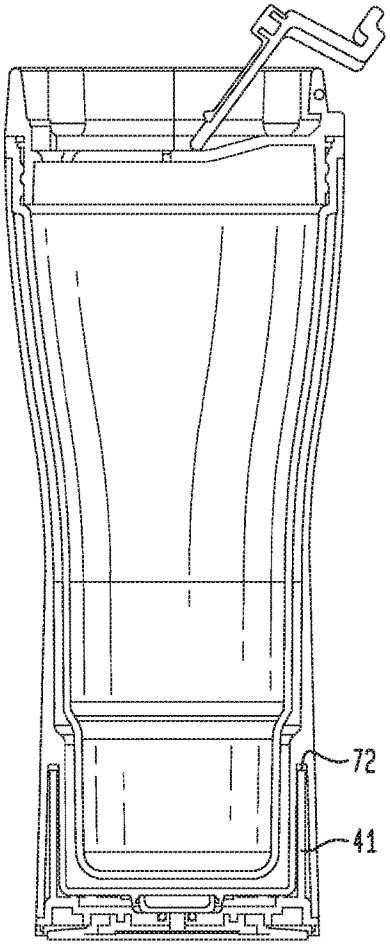
FIG. 2B shows a cross-sectional view of the stable beverage container of FIG. 1.
Figure 2A:
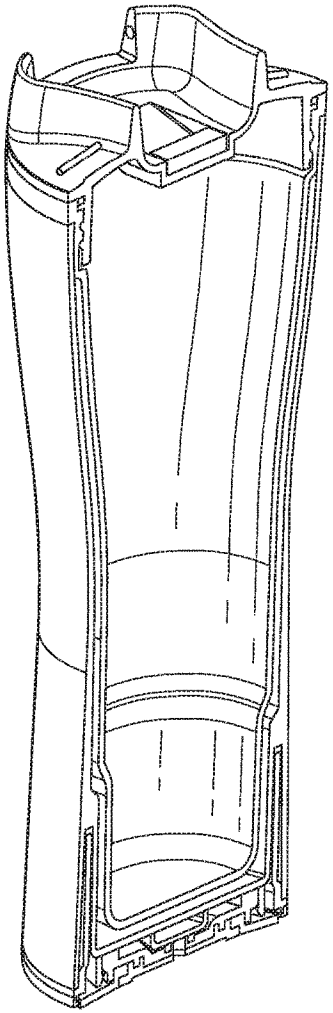
FIG. 2A shows a perspective, cross-sectional view of the stable beverage container of FIG. 1.

FIG. 1 further illustrates that the beverage container 1 may include a lid 11. The lid may be sized, shaped and/or configured to cooperate with the inner cup 8. In some embodiments, the lid 11 may include engagement means 112 that may be configured to engage with an inner surface of the inner cup 8 and maintain the lid 11 in a desired position relative to the inner cup 8. For example, in some embodiments, and as illustrated in FIGS. 2A and 2B, which show cross-sectional views of the beverage container 1, the engagement means 112 may include threading, such that the lid 11 may threadingly engage the inner cup 8. FIGS. 1, 2A, and 2B further illustrate that the lid 8 may include a rim 113 that may be configured to engage the outer rim 81 of the inner cup 8 when the lid 11 is fully engaged with the inner cup 8.

The lid 11 may further include at least one opening in a top surface thereof (not shown) that may be size, shaped and/or configured for an individual using the beverage container 1 to consume or pour liquid therefrom. In some embodiments, the lid 11 may also include a mechanism for transitioning the at least one opening between an open position to a closed position 15. For example, FIGS., 1, 2A, and 2B illustrate that the mechanism 15 may be a stopper that may be configured to engage a top surface of the lid 11 in a manner such that it may be configured to pivot relative to the top surface of the lid 11 and transition between the open and closed positions. FIGS. 1, 2A and 2B further illustrate that in some embodiments, the stopper 15 may include a plug 16 that may be sized, shaped and/or configured to engage the at least one opening in the top surface of the lid 11 when the stopper 15 pivots relative to the top surface of the lid 11 from the open position to the closed position.

FIG. 1 further illustrates that the beverage container 1 may include a base 4 that may be configured to engage the outer cup 7. In some embodiments, the base 4 may include an upper portion 41 that may be sized, shaped and/or configured to engage a corresponding slot 72 in the wall of the outer cup 7. As illustrated in FIGS. 2B and 2C, the slot 72 may be sized, shaped, and/or configured in the wall of the outer cup 7 such that it may receive the upper portion 41 of the base 4 from the bottom end of the outer cup 7.

Figure 3:
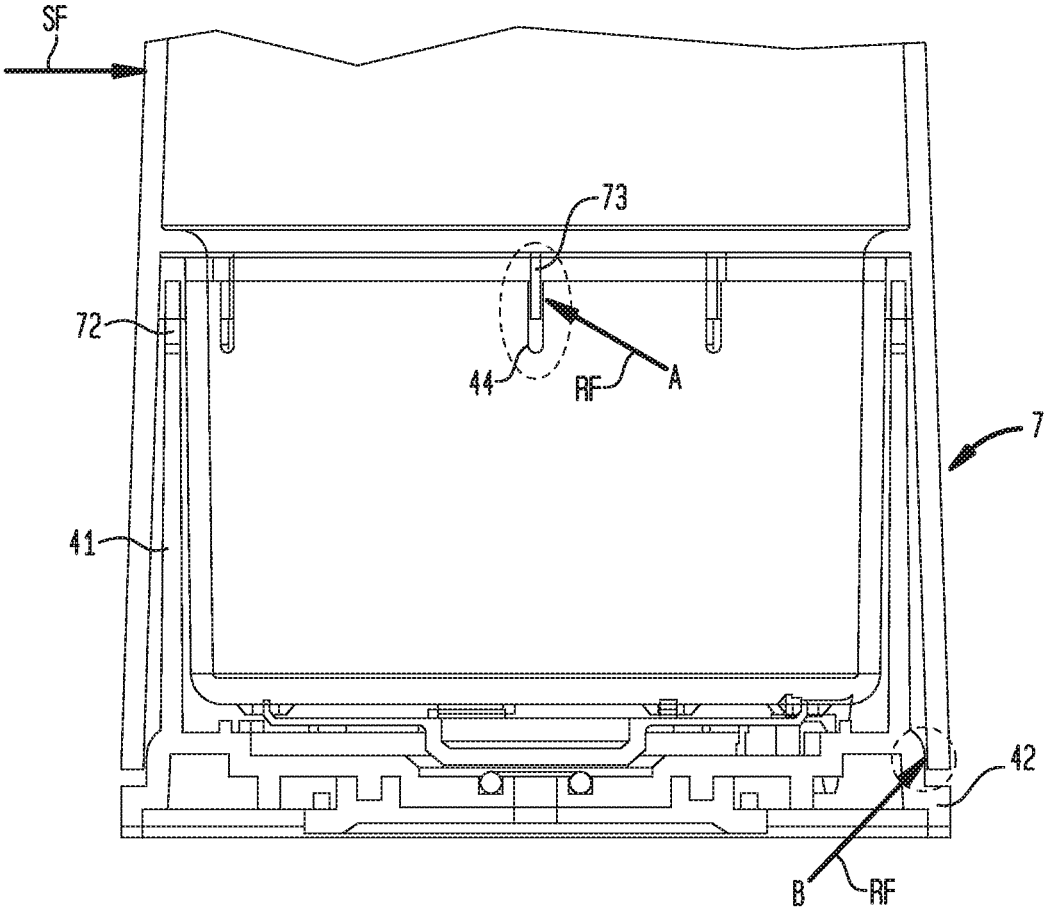
FIG. 3 shows an alignment system of the stable beverage container of FIG. 1, according to an exemplary embodiment.

FIG. 3 illustrates an exploded view of the base 4 engaging the outer cup 7. As illustrated in FIG. 3, the base 4 and the outer cup 7 may include tip-resistant mechanisms A, B. The tip-resistant mechanisms A, B may include components on and/or within the base 4 and the slot 72 that, when engaged, may be configured to aid in preventing tipping of the beverage container 1 when lateral or side forces are exerted on the beverage container 1. For example, the tip-resistant components may be configured to exert reactive forces RF on the beverage container 1 in response to lateral or side forces SF exerted on the beverage container 1.

FIG. 3 illustrates that the beverage container may include first and second tip-resistant mechanisms A, B. The first tip-resistant mechanism A may include at least one projection 73 located within the slot 72. The at least one projection 73 may be configured to engaged a corresponding notch 44 in the upper portion 41 of the base 4. The first tip-resistant mechanism A may also be configured to maintain the outer cup 7 from rotating relative to the base 4. FIG. 3 further illustrates the second tip-resistant mechanism B may include an edge of a bottom portion 42 of the base 4 that may be configured to engage the slot 72 and maintain stability of the outer cup 7 relative to the base 4.

Returning to FIG. 1, the beverage container 1 may include a third tip-resistant mechanism 2 that may be configured to substantially prevent the beverage container from being knocked over in response to a side force exerted thereon. As illustrated in FIG. 1, the third tip-resistant mechanism 2 may be a suction cup 2 that may be sized, shaped and/or configured to engage the bottom portion 42 of the base 4. The suction cup 2 may further be sized, shaped and/or configured such that when the suction cup 2 is pressed up against a relatively flat surface (e.g., table, desk, or counter) and the air underneath the suction cup 2 is squeezed out, a temporary seal may be formed with the surface and the suction cup 2. Accordingly, the suction cup 2 may be configured to removably seal the beverage container 1 to a desired surface in a manner such that when the beverage container 1 is sealed to the surface via the suction cup 2, the beverage container 1 may maintain its position on the surface when lateral or side forces are exerted on the beverage container 1.

FIG. 1 illustrates that the beverage container 1 may further include at least one component for engaging the suction cup 2 to the base 4. The at least one component may be any component known to those skilled in the art that may be configured to maintain the suction cup 2 in connection with the bottom portion 42 of the base 4. For example, in some embodiments, the at least one component may include a ring 6, a suction cup mount 3, and/or one or more connecting parts 10 (e.g., screws or pins). The components 3, 6, 10 may be configured to cooperate with the suction cup 2 and mount the suction cup 2 to the bottom portion 42 of the base 4.

Figure 4A:
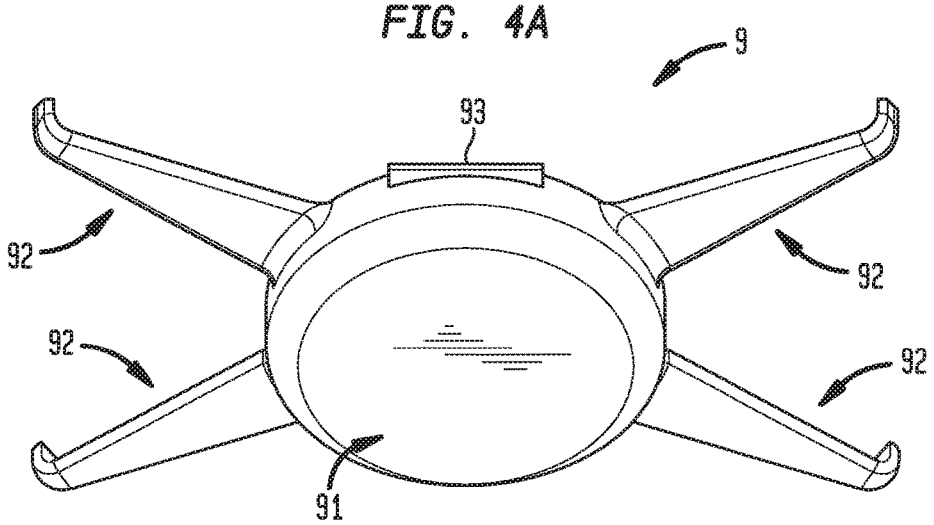
FIG. 4A shows a valve of the stable beverage container of FIG. 1, according to an exemplary embodiment.
Figure 4B:
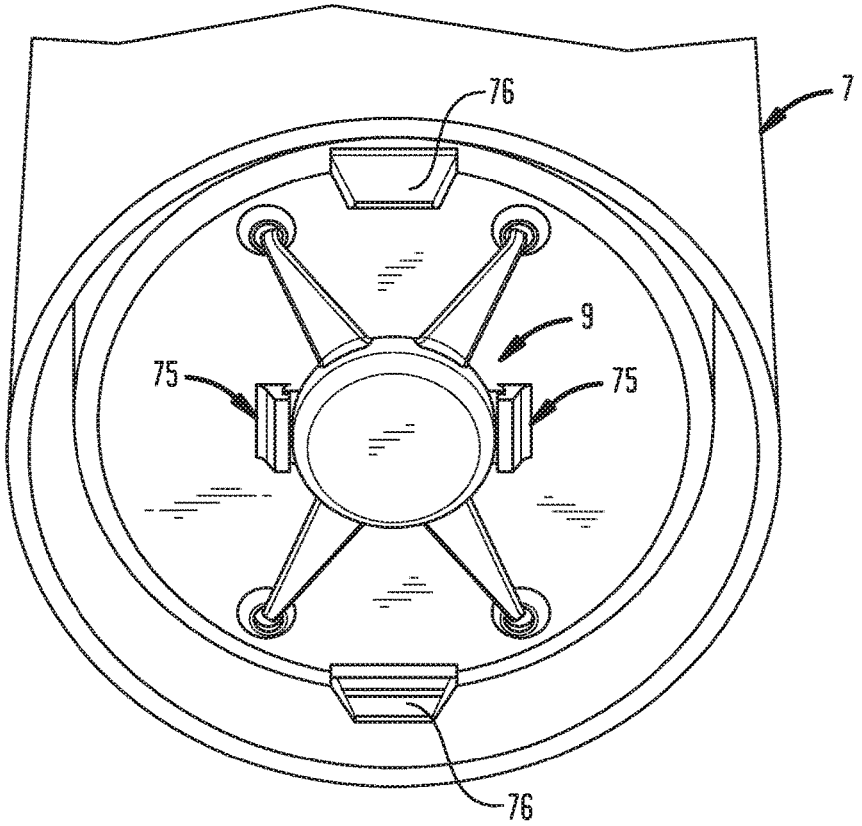
FIG. 4B shows the valve of FIG. 4A engaged with the stable beverage container of FIGS. 1.
Figure 5A:
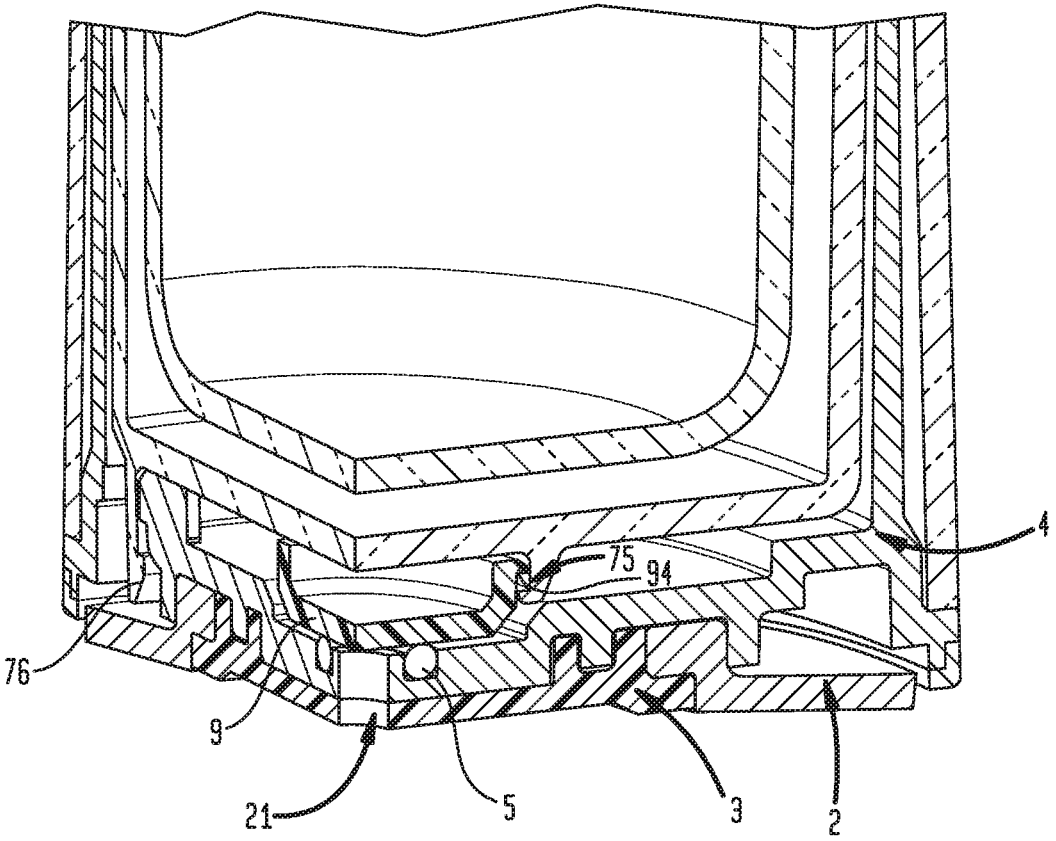
FIGS. 5A-C show cross-sectional views of the bottom of the stable beverage container of FIG. 1.
Figure 5B:
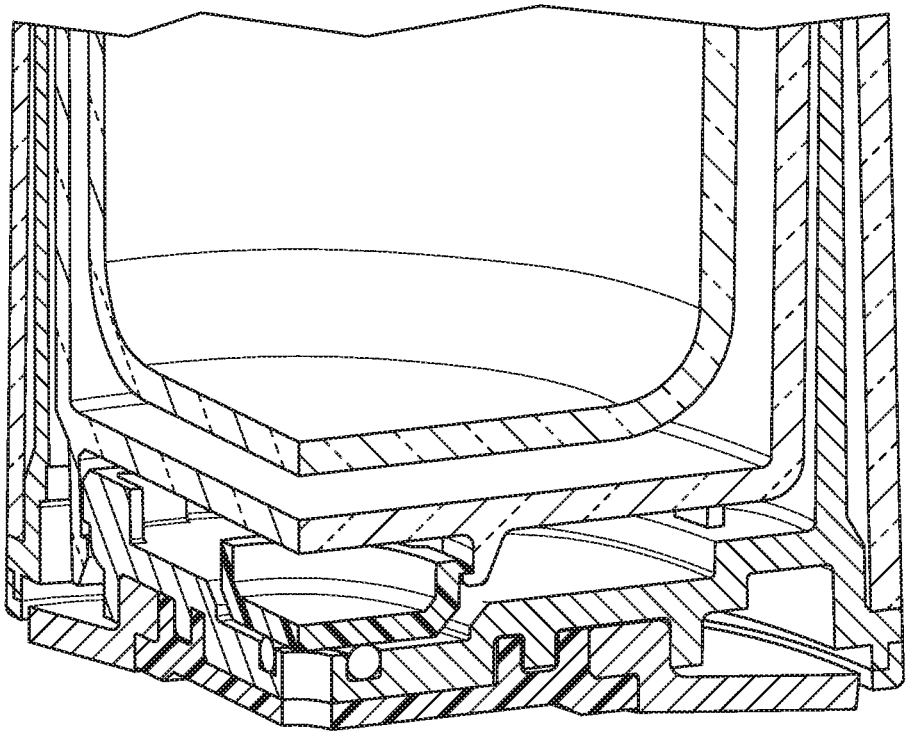
Figure 5C:
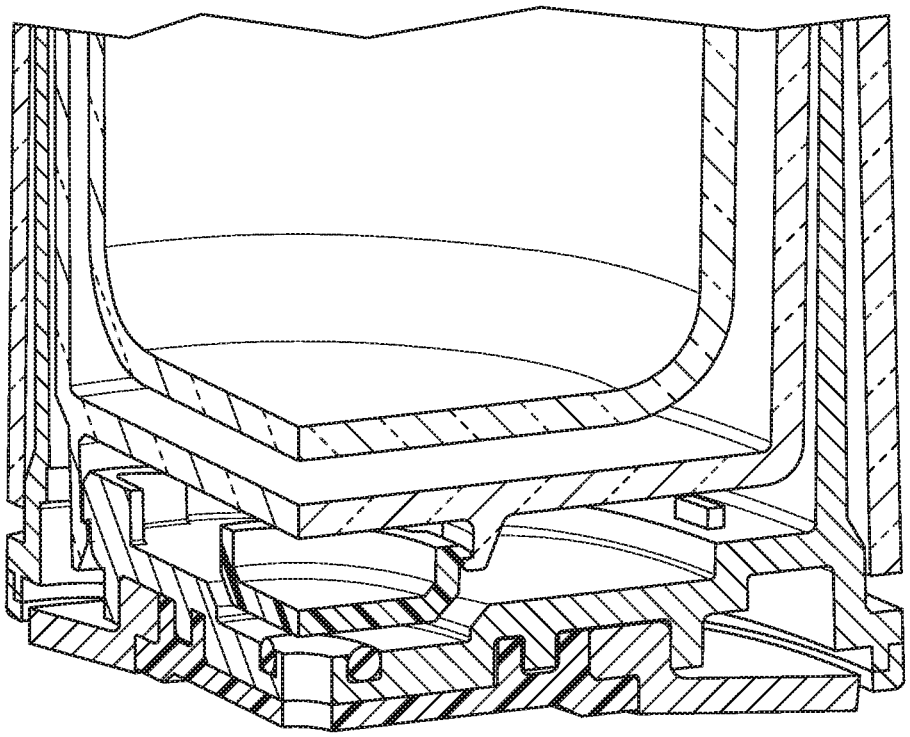

The beverage container 1 may further include a valve 9 (see FIGS. 4A-B) that may be configured to cooperate with the suction cup 2. For example, in some embodiments, the valve 9 may be configured to transition between a first position, in which the suction cup 2 is sealed to a surface, and a second position, which breaks the seal between the suction cup 2 and the surface. FIGS. 5A-C illustrate that the valve 9 may be sized, shaped and/or configured to be positioned between a bottom of the outer cup 7 and an inner portion of the base 4. As illustrated in FIG. 4A, the valve 9 may include a plurality of arms 92 that may extend from a central portion 91 of the valve and may be engaged to the bottom of the outer cup 7 via any suitable engagement means.

In some embodiments, the plurality of arms 92 may be sized, shaped and/or configured as spring-like mechanisms, such that the plurality of arms 92 may be configured to bias the central portion 91 in sealing engagement with an opening of a port 21 (see FIG. 5A) and an O-ring 5 that may be positioned in a groove within the inner surface of the base 4 and extending around the opening of the port 21. The port 21 may be configured such that it may extend through the suction cup mount 3 and the bottom portion 42 of the base 4. The port 21 may be in communication with the suction cup 2 such that when the valve is no longer sealingly engaged to the port 21, air may travel through the port 21 to the suction cup 2, preventing the suction cup 2 from forming a seal with a surface.

In some embodiments, the valve 9 may be configured to remain sealingly engaged to the port 21 until a force above a pre-determined threshold is exerted on the valve 9 in a vertical direction away from the suction cup 2. For example, in some embodiments, the bottom 72 of the outer cup 7 may include at least one tab 75 that may be configured to exert a vertical force on an upper edge 94 of the valve 9. Particularly, the at least one tab 75 may be configured to exert the vertical force on the upper edge 94 of the valve 9 when the suction cup 2 is sealed to a surface and the beverage container 1 is pulled vertically upward, away from the surface.

FIGS. 5A-C illustrate a sequence of cross-sectional views of the bottom portion of the beverage container 1 as the beverage container 1 is transitioned from a position where the suction cup 2 may be sealed to a surface (FIGS. 5A, 5B) to a position where the suction cup 2 may no longer be sealed to the surface (FIG. 5C). As illustrated in FIG. 5A, prior to vertical upward movement of the beverage container 1 away from the surface, the at least one tab 75 may not be engaging the edge 94 of the valve. FIG. 5B illustrates that in some embodiments, the beverage container 1 may be moved in a vertically upward direction, away from the surface, and the valve 9 may remain sealingly engaged to the port 21. FIG. 5C illustrates that after the at least one tab 75 engages the edge 94 of the valve 9 and a vertically upward force above a predetermined threshold is exerted, the valve 9 may no longer be sealingly engaged to the port 21, such that air may travel through the port 21 to the suction cup 2. FIGS. 4A and 5A-C further illustrate that in some embodiments, the beverage container 1 may also include one or more tabs 76 configured to engage an edge of the base 4 such that when the vertical upward force is exerted on the beverage container 1, the one or more tabs 76 may engage the edge of the base 4 and help remove the beverage container 1 from a surface.

Figure 6A:
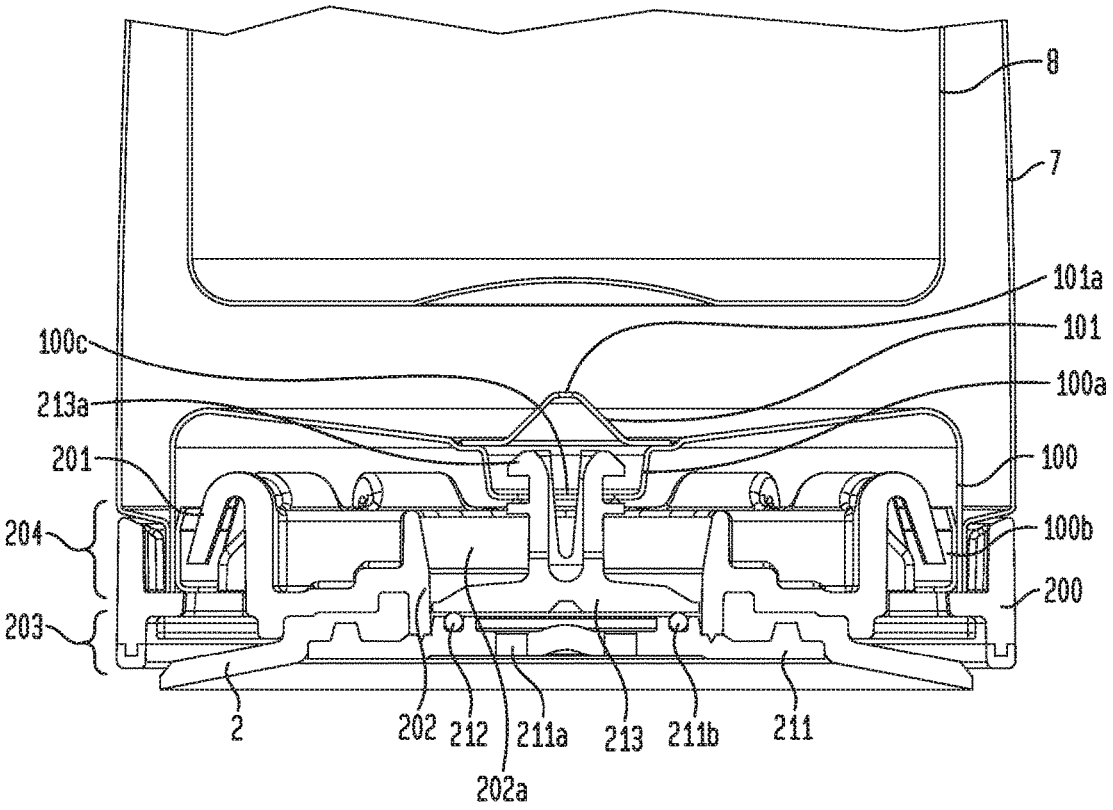
FIG. 6A-D show cross-sectional views of the bottom of an exemplary embodiment of the stable beverage container.
Figure 6B:
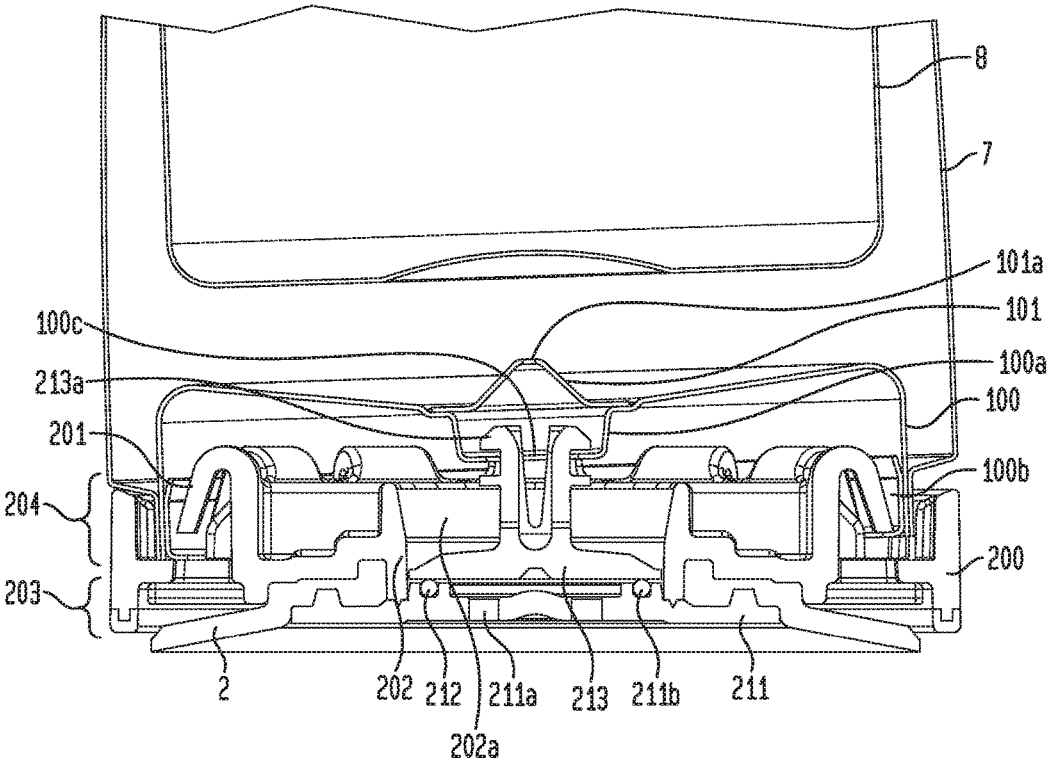
Figure 6C:
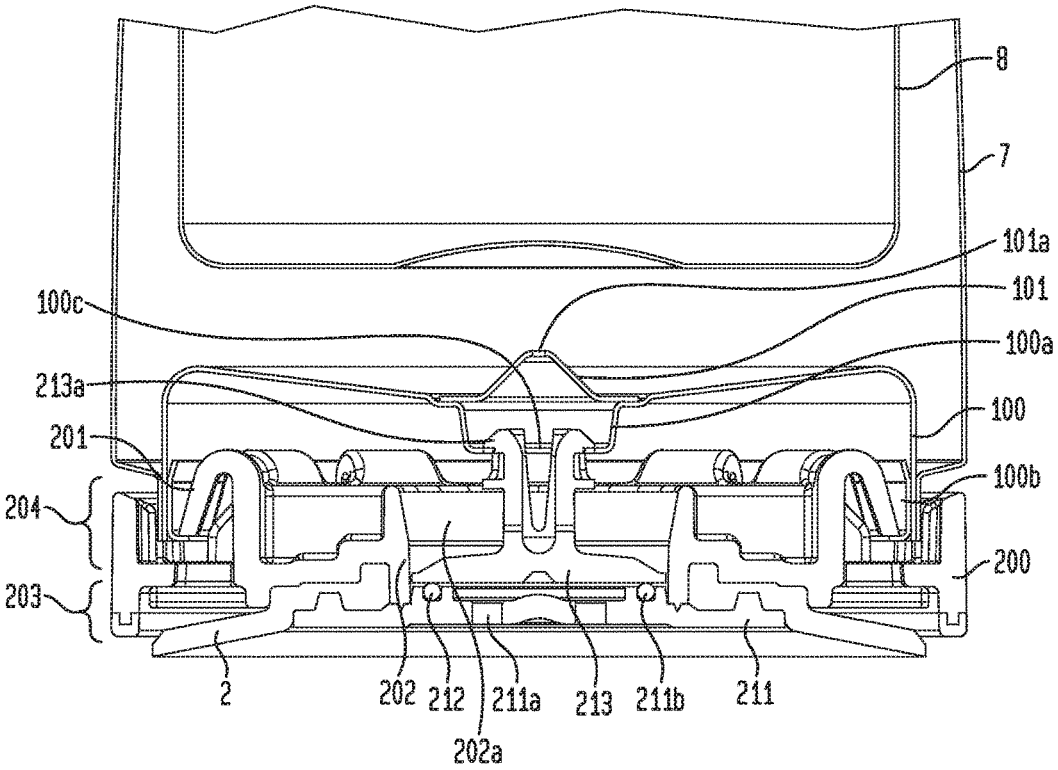
Figure 6D:
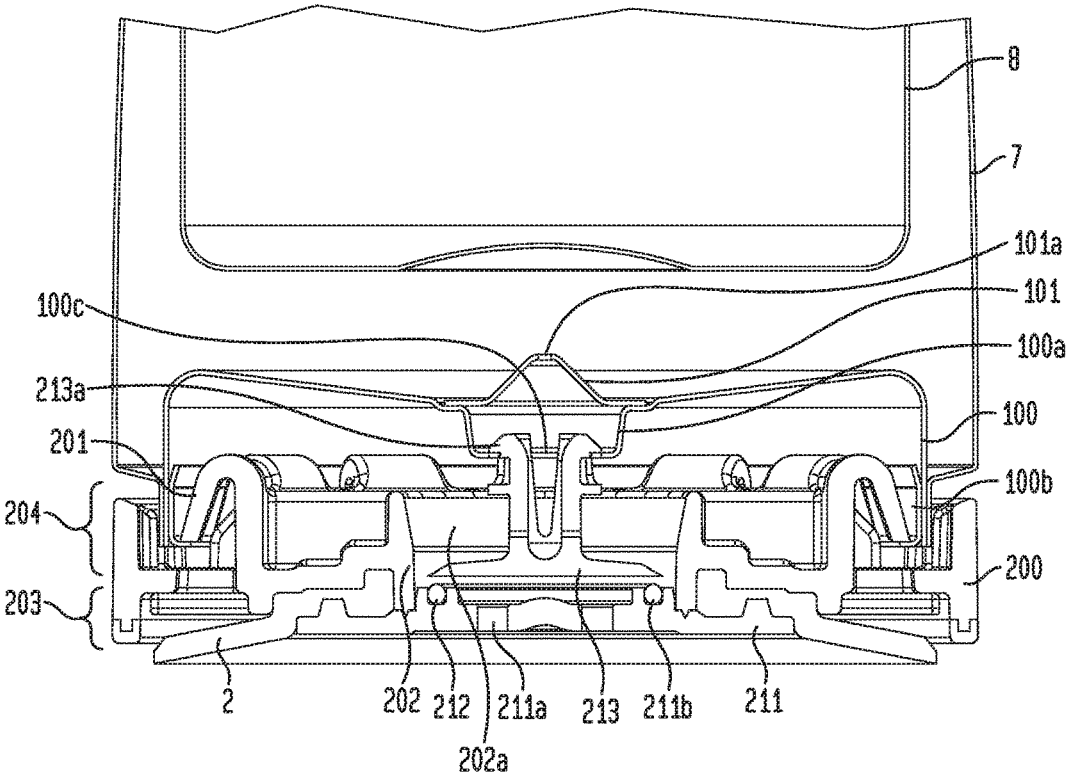

FIGS. 6A-6D illustrate the bottom portion of yet another exemplary beverage container 1. FIGS. 6A-D illustrate a sequence of cross-sectional views of the bottom portion of the beverage container 1 as the beverage container 1 is transitioned from a position where the suction cup 213 may be sealed to a surface (FIG. 6A), to a position where a lateral force may have been applied to container 1 so that container 1 is tilted from vertical but still secured to the surface (FIG. 6B), to a position just prior to container 1 no longer being sealed to the surface (FIG. 6C) (e.g., just prior to valve 213 being lifted off O-ring 212), and to a position where valve 213 has been lifted off O-ring 212 so that container 1 is no longer sealed to the surface (FIG. 6D). As shown in FIGS. 6A-6D, the exemplary beverage container may include a base 200, which can be coupled to the bottom of container 1 and be configured to have two operational states. In the first state, base 200 can be removably secure to a surface on which container 1 is placed so as to prevent beverage container 1 from tipping, i.e., the base 200 may be configured to substantially prevent the beverage container 1 from being knocked over in response to a lateral force exerted thereon. In the second operational state, base 200 is not securing container 1 to the surface on which container 1 is placed. As shown in FIGS. 6A-6D, base 200 can include a lower portion 203, upper portion 204, valve 213, suction cup 2, suction cup mount 211, port 211*a*, and O-ring 212. Lower portion 203, upper portion 204, valve 213, suction cup 2, suction cup mount 211, port 211*a*, and O-ring 212 can be operatively coupled to transition between the two operational states so as to removably secure container 1 onto a surface to substantially prevent container 1 from being knocked over and allow container 1 to be freely removed from the surface on which it is placed.

FIGS. 6A-6D show container 1 in the first state where base 200 is removably securing container 1 to a surface on which it is placed. As shown in FIG. 6A, air has been forced out of the cavity formed by suction cup 2 and valve 213 is seated on O-ring 212 so as to form a seal with O-ring 212, thereby preventing air to pass through port 211*a* and allow the cavity to return to atmospheric pressure. Accordingly, valve 213, O-ring 212, and suction cup 2 cooperatively act to form a vacuum in the cavity formed by suction cup 2 to removably seal container 1 on the surface on which container 1 is placed. Further, upper portion 204 may include features, such as radially disposed spring clips 201, which can engage circumferential lip 100*b* disposed along the inner circumference of plate 100 to couple base 200 to the bottom of container 1.

As shown in FIG. 6B, base 200 is in the first operational state securing container 1 to the surface, and a lateral force has been applied to container 1 causing container 1 to tip. In this situation, container may be displaced from vertical because of a lateral force applied to container 1. In this regard, base 200 may include features to define the maximum displacement that container 1 can be displaced from vertical by limiting the distance to a predetermined distance so as to prevent container 1 from causing valve 213 to break the seal with O-ring 212. As shown in FIG. 6B, spring clips 201 and circumferential lip 100*b* can be configured to define the predetermined tilting distance of container 1 so that valve 213 maintains its seal. For example, spring claims 201 and circumferential lip 100*b* can be configured to have a certain amount of play so that container 1 can be displaced from vertical the predetermined distance, and further displacement is prevented by the engagement of spring claims 201 with circumferential lip 100*b*. Accordingly, the amount the container 1 can be tilted past vertical is proportional to the amount of play that is provided between spring clips 201 and circumferential lip 100*b*. Further, the amount of play between spring clips 201 and circumferential lip 100*b* can be adjusted to obtain a desired amount of maximum displacement of container 1.

As shown in FIG. 6D, base 200 is in the second operational state where container 1 is not removably secured to the surface. In the second operational state, valve 213 does not form a seal with O-ring 212, so that port 211*a* can vent to atmospheric pressure. In this state, container 1 is not removably secured to the surface and can freely be removed from the surface. FIG. 6C shows container 1 being displaced vertically relative to the view shown in FIG. 6A. As shown in FIG. 6C, the container is positioned where central protrusion 100*a* is about to engage arms 213*a* but has not yet lifted valve 213 so as to break the seal between valve 213 and O-ring 212. Further vertical displacement of container 1 from this position would cause protrusion 100*a* to engage arms 213*a* and lift valve 213 so as to break the seal between valve 213 and O-ring 212, allowing air to pass through ports 211*a* enabling the cavity formed by suction cup 2 to return to atmospheric pressure such that container 1 is no longer secured to the surface.

As shown in FIGS. 6A-6D, according to certain exemplary embodiments, port 211*a* may be formed in suction cup mount 211 extending through suction cup mount 211 to selectively allow fluid communication between the atmosphere and the cavity formed by suction cup 2 based on the position of valve 213. Further, suction cup mount 211 may include groove 211*b* to secure and house O-ring 212. O-ring 212 may be radially aligned with central hole 202*a*. Additionally, valve 213 may be sized, shaped and/or configured to removably seat on O-ring 212 and centrally positioned in central hole 202*a* of base 200. The central hole 202*a* may additionally include tabs (not shown) along wall 202 to radially align valve 213 in central hole 202*a* such that the valve is radially aligned with O-ring 212. As illustrated in FIG. 6A-D, valve 213 may include a plurality of arms 213*a* that may extend upward from the valve 213 and are received in central hole 100*c* such that arms 213*a* can engage the central protrusion 100*a*. Arms 213*a* may be configured to operatively engage central protrusion 100*a* to enable vertical movement of valve 213 from the first operational state, where valve 213 may sealingly engage O-ring 212, and the second operational state where valve 213 is not sealingly engaging O-ring 212. In the first operational state, valve 213 seals ports 211*a*, thereby preventing the cavity formed by suction cup 2 to return to atmospheric pressure. In the second operational state, valve 213 is no longer sealingly engaged to O-ring 212, thereby allowing ports 211*a* to be in fluid communication with the cavity formed by suction cup 2 and the atmosphere so that the air may travel through the ports 211*a* so that the cavity formed by suction cup 2 can return to atmospheric pressure.

According to certain exemplary embodiments, as described herein, the inner cup 8 may be sized relative to the outer cup 7 such that when the inner cup 8 is fully engaged with outer cup 7, a space exists between the outer surface of the bottom portion of the inner cup 8 and the inner surface of the outer cup 7. As shown in FIGS. 6A-6D, outer cup 7 may include an integrally formed plate 100 that may be sized, shaped and/or configured to seal the space between the bottom portion of the inner cup 8 and the inner surface of the outer cup 7. This may be desirable to aid in insulation of beverages being held in the beverage container. The plate 100 may further includes a central protrusion 100*a* with a central hole 100*c*, thereby enabling the plate 100 to be easily manufactured using techniques known in the art, such as hydraulic press, rolling, spinning. Additionally, a conical section 101 with a central hole 101*a* may be placed on central protrusion 100*a* thereby sealing central hole 100*b*. This may be desirable in order to completely seal the space between the outer surface of the bottom portion of the inner cup 8 and the inner surface of the outer cup 7. Additionally, this may be preferable for creating vacuum-sealed insulation for the beverage container. Preferably, the outer cup 7, plate 100 and conical protrusion 101 may be constructed of stainless steel. This may be preferably for enabling vacuum-sealing of the space between outer cup 7 and inner cup 8 and for improved insulation of the beverage in the beverage container. Furthermore, inner cup 8 may be lined with a ceramic coating on the inner surface to further aid in insulation of the beverage in the beverage container 1. Additionally, conical section 101 may be placed on the central protrusion 100*a* in an inverted position, i.e., with the cone facing the opposite direction as the central protrusion 100*a*.

The embodiments and examples above are illustrative, and many variations can be introduced to them without departing from the spirit of the disclosure or from the scope of the appended clams. For example, elements and/or features of different illustrative and exemplary embodiments herein may be combined with each other and/or substituted with each other within the scope of this disclosure. The objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

What is claimed:

1. A beverage container comprising:

an outer cup having an integrally formed base plate;

an inner cup disposed in the outer cup;

a base including a lower portion configured to releasably engage the beverage container to an external surface, the lower portion including a suction cup defining a cavity and configured to sealingly engage the beverage container with an external surface by forming a seal between the suction cup and the external surface; and a valve including projections configured to operatively engage the integrally formed base plate and movable a vertical displacement of a predetermined distance between a first position and a second position to control fluid communication between atmospheric pressure and the cavity, the first position including the valve being sealingly engaged with the lower portion of the base thereby preventing fluid communication between the cavity and atmospheric pressure so as to sealingly engage the beverage container to the external surface and the second position including the valve being disposed in a position to allow fluid communication between the cavity and atmospheric pressure such that the beverage container is not sealingly engaged to the external surface and the predetermined distance being defined by a configuration of the projections and the integrally formed base plate moves the valve between the first and second positions.

2. The beverage container of claim 1, wherein the lower portion of the base includes at least one port extending therethrough, the at least one port allowing fluid communication between the cavity and atmospheric pressure.

3. The beverage container of claim 1, wherein the lower portion includes an O-ring, and the valve is sealingly engaged with the O-ring in the first position.

4. The beverage container of claim 1, wherein the valve is operably coupled with the integrally formed base plate such that when the outer cup is displaced a second predetermined distance, the valve remains sealingly engaged with the lower portion of the base.

5. A beverage container comprising:

an outer cup having an integrally formed base plate;

an inner cup disposed in the outer cup;

a base including an upper portion and a lower portion, the upper portion of the base having clips configured to operatively engage a circumferential lip of the integrally formed base plate, the lower portion configured to releasably engage the beverage container to an external surface and including a suction cup defining a cavity and configured to sealingly engage the beverage container with an external surface by forming a seal between the suction cup and the external surface; and a valve operably connected to the integrally formed base plate and movable between a first position and a second position to control fluid communication between atmospheric pressure and the cavity, the first position including the valve being sealingly engaged with the lower portion of the base thereby preventing fluid communication between the cavity and atmospheric pressure so as to sealingly engage the beverage container to the external surface, wherein a configuration of the clips and the circumferential lip define a predetermined distance, such that when the outer cup is laterally displaced up to the predetermined distance, the valve remains sealingly engaged with the lower portion of the base.

6. The beverage container of claim 3, wherein the base includes tabs to centrally align the valve relative to the O-ring.

7. The beverage container of claim 1, wherein the outer cup includes stainless steel.

8. The beverage container of claim 1, wherein the inner cup includes a ceramic lining.

9. The beverage container of claim 1, wherein a space between the outer cup and the inner cup includes a vacuum seal.

10. A beverage container comprising:

an outer cup having an integrally formed base plate;

an inner cup disposed in the outer cup;

a base including a lower portion configured to releasably engage the beverage container to an external surface and an upper portion including clips configured to operatively engage a circumferential lip of the integrally formed base plate, the lower portion including:

a suction cup defining a cavity and configured to sealingly engage the beverage container with an external surface by forming a seal between the suction cup and the external surface;

at least one port extending therethrough, the at least one port allowing fluid communication between the cavity and atmospheric pressure; and an O-ring;

a valve including projections configured to operatively engage the integrally formed base plate and movable between a first position and a second position to control fluid communication between atmospheric pressure and the cavity, wherein the first position includes the valve being sealingly engaged with the lower portion of the base thereby preventing fluid communication between the cavity and atmospheric pressure to sealingly engage the beverage container to the external surface and the second position includes the valve being disposed in a position allowing fluid communication between the cavity and atmospheric pressure such that the beverage container is not sealingly engaged to the external surface.

11. The beverage container of claim 10, wherein the valve is sealingly engaged with the O-ring in the first position.

12. The beverage container of claim 10, wherein the base includes tabs to centrally align the valve with the O-ring.

13. The beverage container of claim 10, wherein a configuration of the projections and the integrally formed base plate define a first predetermined distance, such that a vertically displacement of the first predetermined distance of the valve moves the valve between the first and second positions.

14. The beverage container of claim 10, wherein a configuration of the clips and the circumferential lip define a second predetermined distance, such that when the outer cup is laterally displaced up to the second predetermined distance, the valve remains sealingly engaged with the lower portion of the base.

15. The beverage container of claim 10, wherein the outer cup includes stainless steel.

16. The beverage container of claim 10, wherein the inner cup includes a ceramic lining.

17. The beverage container of claim 10, wherein a space between the outer cup and the inner cup includes a vacuum seal.

* * * * *